US005204717A

United States Patent [19]

Reese et al.

[11] Patent Number: 5,204,717

[45] Date of Patent: Apr. 20, 1993

[54] PHOTORECEPTOR REMOVAL MECHANISM FOR A PRINTING MACHINE

[75] Inventors: Scott A. Reese, Farmington; Richard M. Dastin, Fairport; Douglas W. Gates, Rochester; Robert J. Tannascoli, Webster, all of N.Y.

[73] Assignee: Xerox Corporation, Stamford, Conn.

[21] Appl. No.: 739,008

[22] Filed: Aug. 1, 1991

[51] Int. Cl.[5] ..... G03G 15/02

[52] U.S. Cl. ..... 355/219; 355/212

[58] Field of Search ..... 250/324, 325, 326; 361/221; 355/210, 211, 212, 219, 221; 474/112, 113, 115, 117

[56] References Cited

U.S. PATENT DOCUMENTS

| | | | |
|---|---|---|---|
| 3,358,522 | 12/1967 | Poyser et al. | 74/242.11 |
| 3,801,092 | 4/1974 | Jordan | 271/197 |
| 4,332,458 | 6/1982 | Hoffman | 355/212 |
| 4,355,882 | 10/1982 | Snelling | 355/3 B E |
| 4,416,532 | 11/1983 | Rosati | 355/212 |
| 4,483,607 | 11/1984 | Nagayama | 355/212 |
| 4,713,043 | 12/1987 | Biedermann | 474/111 |
| 4,803,517 | 2/1989 | Bruce, Jr. | 355/202 |
| 4,869,707 | 9/1989 | Zandt et al. | 474/115 |
| 4,983,146 | 1/1991 | Charles et al. | 474/117 |
| 4,985,010 | 1/1991 | Henderson | 474/135 |
| 4,996,563 | 2/1991 | Blanding | 355/212 |

FOREIGN PATENT DOCUMENTS

| | | | |
|---|---|---|---|
| 0173784 | 10/1983 | Japan | 355/212 |
| 0095461 | 5/1985 | Japan | 355/212 |

*Primary Examiner*—R. L. Moses
*Assistant Examiner*—J. E. Barlow, Jr.

[57] ABSTRACT

An apparatus is described which records an electrostatic latent image on a charger receiver. The apparatus includes a module which includes a bracket upon which a corona generating device is removably mounted. The bracket is also adapted to pivot so as to facilitate removal of the photoconductive member from the module.

23 Claims, 8 Drawing Sheets

PHOTORECEPTOR REMOVAL MECHANISM FOR A PRINTING MACHINE

This invention relates generally to an electrophotographic printing machine, and more particularly concerns an apparatus for recording an electrostatic latent image on a photoconductive member.

The marking engine of an electronic reprographic printing system is frequently an electrophotographic printing machine. In an electrophotographic printing machine, a photoconductive member is charged to a substantially uniform potential to sensitize the surface thereof. The charged portion of the photoconductive member is thereafter selectively exposed in an imaging zone to a light source such as a raster output scanner. Exposure of the charged photoconductive member dissipates the charge thereon in the irradiated areas. This records an electrostatic latent image on the photoconductive member corresponding to the information areas contained within the original document being reproduced. After the electrostatic latent image is recorded on the photoconductive member, the latent image is developed by bringing toner into contact therewith. This forms a toner image on the photoconductive member which is subsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complimentary thereto. This process is repeated a plurality of cycles for differently colored images and their respective complimentarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy. The developer material may be a liquid or a powder material.

In each of the above processes of printing, a support member may be positioned to support the portion of the photoconductive member in the imaging zone during exposure thereof. By providing the above support member, the photoconductive member is positioned at a predetermined location relative to the associated light source during exposure thereof. Moreover, the above support member smooths out the photoconductive member as such member is advanced through the imaging zone. As a result, the support member provides for registration of the photoconductive member within the machine thereby reducing magnification and focus errors.

The support member is positioned substantially adjacent the photoconductive member in the imaging zone during normal operation of the machine. When it is desired to replace the photoconductive member, for example due to wear or damage, the support member may be temporarily positioned away from the photoconductive member to assist in removal of the old photoconductive member from the machine. After a new photoconductive member is positioned within the machine, it is necessary to reposition the support member back to a location substantially adjacent the photoconductive member.

A problem which may occur is failure of the person whom is performing the photoconductive member replacement (normally a service technician), to reposition the support member to a location substantially adjacent the new photoconductive member after the new photoconductive member is positioned within the machine. If printing activity were initiated while the printing machine was in the above condition, the copy sheet produced thereby would possess significant image magnification and focus errors thereon. This would require further intervention by the service technician to reenter the printing machine and reposition the support member to a location substantially adjacent the photoconductive member. The above additional intervention would add to the aggregate service cost associated with maintenance of the printing machine. It would be desirable to provide a printing machine which has a photoreceptor removal mechanism which would reduce the instances in which a person replacing a photoconductive member in a printing machine fails to reposition the support member to a location substantially adjacent the new photoconductive member after the new photoconductive member is positioned within the machine.

The following disclosures may be relevant to various aspects of the present invention:

U.S. Pat. No. 3,358,522, Patentee: Poyser et al., Issued: Dec. 19, 1967

U.S. Pat. No. 3,801,092, Patentee: Jordan, Issued: Apr. 2, 1974

U.S. Pat. No. 4,355,882, Patentee: Snelling, Issued: Oct. 26, 1982

U.S. Pat. No. 4,713,043 Patentee: Biedermann, Issued: Dec. 15, 1987

U.S. Pat. No. 4,869,707, Patentee: in't Zandt et al. Issued: Sep. 26, 1989

U.S. Pat. No. 4,983,146, Patentee: Charles et al., Issued: Jan. 8, 1991

U.S. Pat. No. 4,985,010, Patentee: Henderson, Issued: Jan. 15, 1991

The relevant portions of the foregoing disclosures may be briefly summarized as follows:

U.S. Pat. No. 3,358,522 discloses a chain tensioner wherein a chain contacting member is adjustably urged into contact with a chain by a spiral cam. The cam is adjustably and resiliently urged against a shoe and moreover a spring means is provided to restrict contra-rotation of the cam to maintain the shoe in adjusted contact with the chain.

U.S. Pat. No. 3,801,092 describes a vacuum holddown device for use in an apparatus employing flexible web material in a flattened condition. A perforated plenum plate is joined to a manifold connectable to a vacuum producing means. A plurality of ribs are formed on the plate between it and the manifold. When the space between the plenum plate and manifold is evacuated the latter is forced against the ribs. The above holddown device is positioned between a pair of rollers substantially adjacent a photoreceptor belt in the exposure run of an electrostatic reproduction machine.

U.S. Pat. No. 4,355,882 discloses a multi-mode copying apparatus. The apparatus includes a number of belt support rolls on which a photoconductive belt is entrained. The apparatus further includes a laser which generates a beam of light which is directed to the surface of the belt. The beam impinges on the surface of the belt at a location opposite one of the belt support rolls.

U.S. Pat. No. 4,713,043 describes a chain tensioner which includes a piston displaceable in the direction of its axis in a guide housing. The tensioner further includes a tensioner bar articulated to the guide housing and a piston head which is operatively coupled to the piston.

U.S. Pat. No. 4,869,707 discloses a belt tensioning device for use in a copying machine. The device includes a first moving belt which contacts a second pressure means so that the belt is driven at the speed of the second element.

U.S. Pat. No. 4,983,146 describes a belt tensioning and quick release device for an electrophotographic system. An idler roller which supports a photoreceptor belt is used in conjunction with a cam which provides a take-up feature. A configuration is provided which allows the cam to be disengaged, and the idler roller retracted to facilitate removal of the belt.

U.S. Pat. No. 4,985,010 discloses a belt tensioner for a power transmission belt. The tensioner comprises a support for being fixed relative to a belt, a belt engaging unit carried by the support and being movable relative thereto, a spring operatively associated with the support and the belt engaging unit for urging the belt engaging unit relative to the support and against the belt with the force to tension the belt.

In accordance with one aspect of the present invention, there is provided an apparatus for recording an electrostatic latent image on a charge receiver. The apparatus comprises means for depositing a substantially uniform electrostatic charge receiver and means for selectively dissipating the electrostatic charge on the charge receiver in an imaging zone to record thereon the electrostatic latent image, the dissipating means supporting at least a portion of the charge receiver in the imaging zone. The apparatus further comprises means for removably mounting the charge depositing means substantially adjacent the charge receiver, the mounting means being adapted to position the dissipating means at a first position and at a second position, with the first position allowing for registration of the charge receiver within the apparatus and the second position facilitating removal of the charge receiver from the apparatus.

Pursuant to another aspect of the present invention, there is provided a printing machine which comprises a charge receiver and means for depositing a substantially uniform electrostatic charge on the charge receiver. The printing machine further comprises means for selectively dissipating the electrostatic charge on the charge receiver in an imaging zone to record thereon an electrostatic latent image, the dissipating means supporting at least a portion of the charge receiver in the imaging zone. Moreover, the printing machine comprises means for removably mounting the charge depositing means substantially adjacent the charge receiver, the mounting means being adapted to position the dissipating means at a first position and at a second position, with the first position allowing for registration of the charge receiver within the machine and the second position facilitating removal of the charge receiver from the machine. Additionally, the printing machine comprises means for developing the electrostatic latent image recorded on the charge receiver with toner particles, means for transferring the toner particles to a sheet of support material, in image configuration, and means for substantially permanently fixing the toner particles to the sheet of support material.

Other features of the present invention will become apparent as the following description proceeds and upon reference to the drawings, in which.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 1:
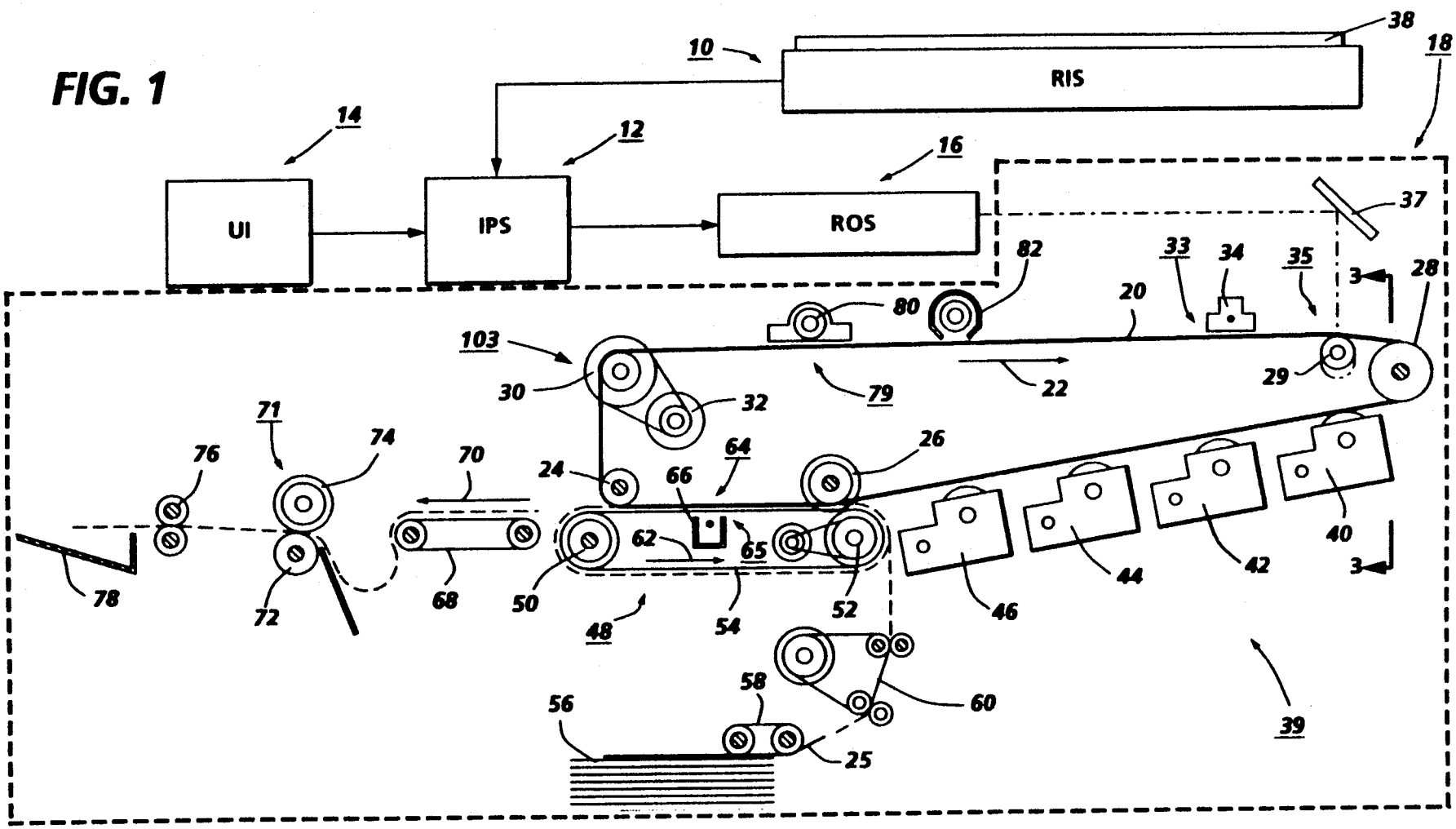
FIG. 1 is a schematic elevational view showing an electrophotographic printing machine incorporating the features of the present invention therein.

For a general understanding of the features of the present invention, reference is made to the drawings. In the drawings, like references have been used throughout to designate identical elements. FIG. 1 is a schematic elevational view showing an electrophotographic printing machine incorporating the features of the present invention therein. It will become evident from the following discussion that the present invention is equally well suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CDD array). The RIS captures the entire image from original document 38 and converts it to a series of raster scan lines and moreover measures a set of primary color densities, i.e. red, green and blue densities, at each point of the original document. This information is transmitted as electrical signals to an image processing system (IPS), indicated generally by the reference numeral 12. IPS 12 converts the set of red, green and blue density signals to a set of calorimetric coordinates. The IPS contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. The IPS then transmits signals corresponding to the desired image to ROS 16, which creates the output copy image. ROS 16 includes a laser with rotating polygon mirror blocks. Preferably, a nine facet polygon is used. The ROS illuminates, via mirror 37, the charged portion of a photoconductive belt 20 of a printer or marking engine, indicated generally by the reference numeral 18, at a rate of about 400 pixels per inch, to achieve a set of subtractive primary latent images. The ROS will expose the photoconductive belt to record three latent images which correspond to the signals transmitted from IPS 12. One latent image is developed with cyan developer material. Another latent image is developed with magenta developer material and the third latent image is developed with yellow developer material. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 of marking engine 18 is preferably made from a polychromatic photo-conductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charge photoconductive surface is rotated to an exposure station, indicated generally by the reference numeral 35. Exposure station 35 receives a modulated light beam corresponding to information derived by RIS 10 having a multi-colored original document 38 positioned thereat. The modulated light beam impinges on the surface of the photoconductive belt at a location opposite an image back-up roller 29. The beam illuminates the charged portion of photoconductive belt to form an electrostatic latent image. The photoconductive belt is exposed three times to record three latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is substantially adjacent the photoconductive belt, while in the non-operative position, the magnetic brush is spaced therefrom. In FIG. 1, developer unit 40 is shown in the operative position with developer units 42, 44 and 46 being in the non-operative position. During development of each electrostatic latent image, only one developer units in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown) extends between belts 54 and moves in unison therewith. A sheet 25 is advance from a stack of sheets 56 disposed on a tray. A friction retard feeder 58 advances the upper most sheet from stack 56 onto a pre-transfer transport 60. Transport 60 advances sheet 25 to sheet transport 48. Sheet 25 is advanced by transport 60 in synchronism with the movement of the sheet gripper. In this way, the lading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. As belts 54 move in the direction of arrow 62, the sheet moves into contact with the photoconductive belt, in synchronism with the toner image developed thereon. In transfer one 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, to the sheet to form the multicolor copy of the colored original document.

After the last transfer operation, the sheet transport system directs the sheet to a vacuum conveyor 68. Vacuum conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 2:
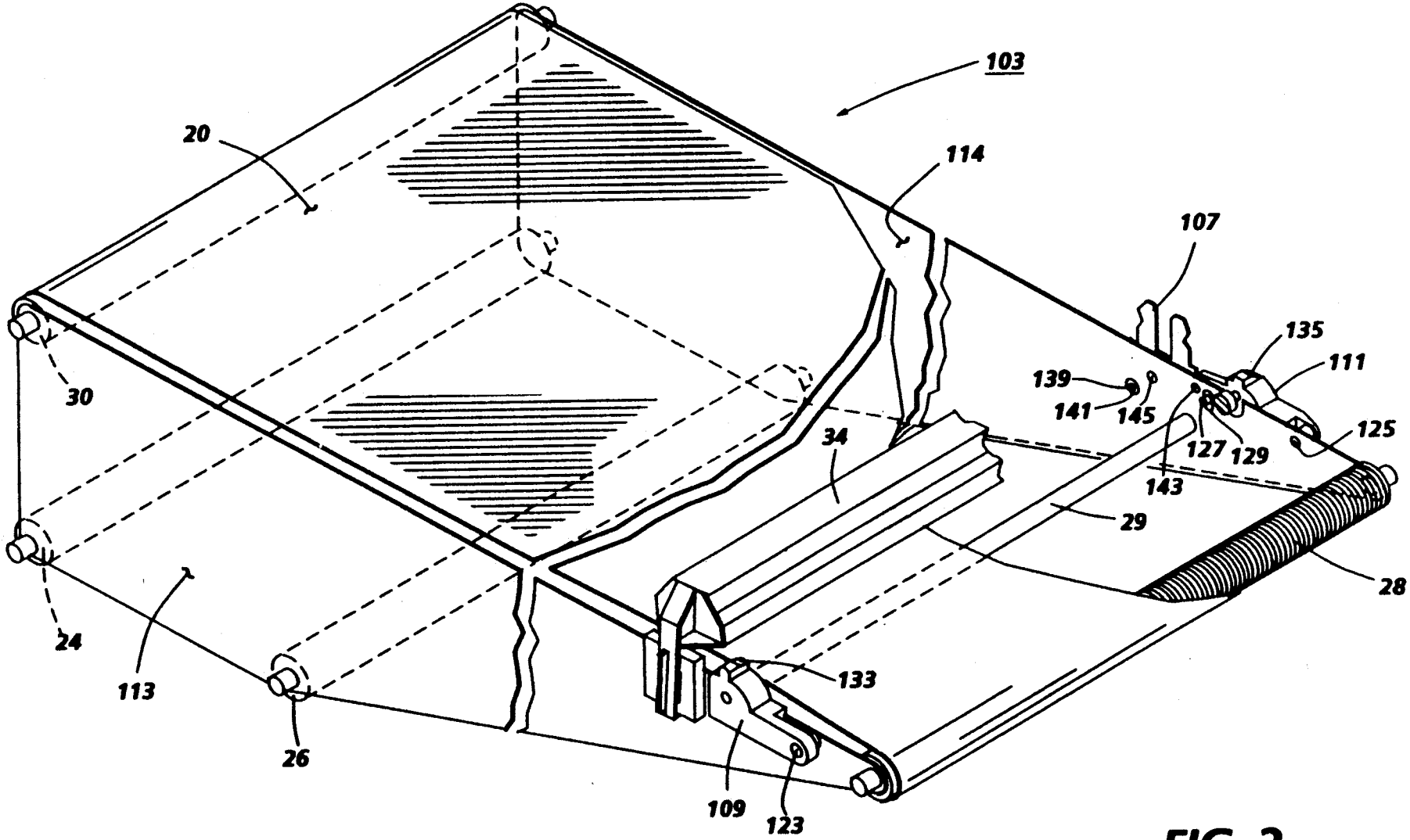
FIG. 2 is a perspective view showing further details of the xerographic module used in the electrophotographic printing machine of FIG. 1.
Figure 5:
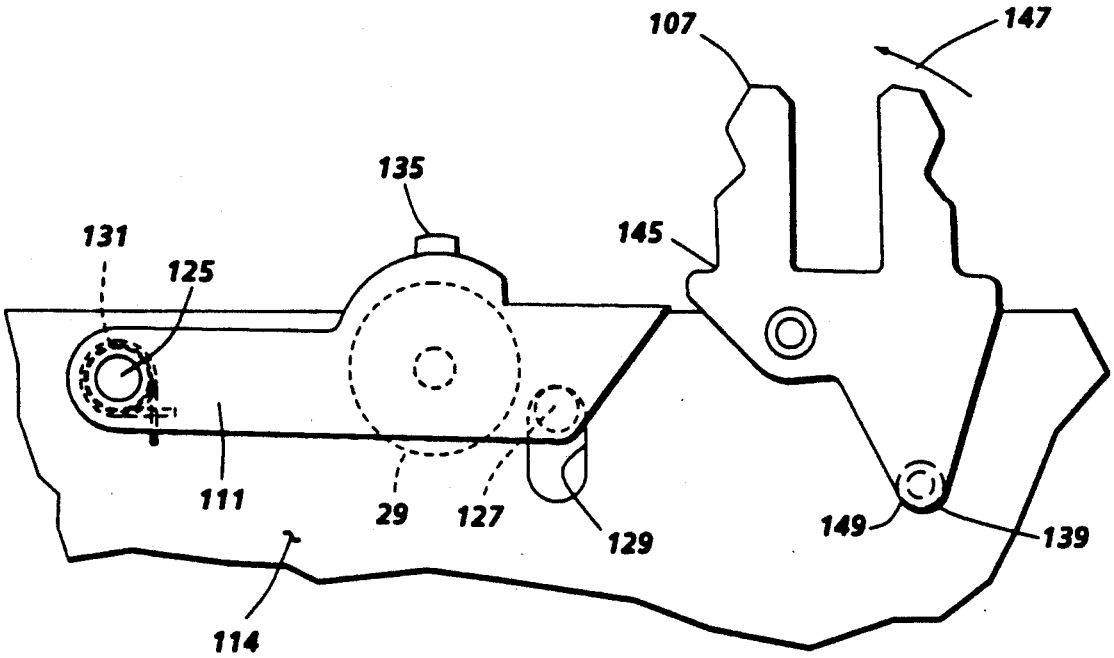
FIG. 5 is a side elevational view showing a portion of the module used in the electrophotographic printing machine of FIG. 1 wherein the inboard arm is shown positioned at its upper-most pivot position.

FIG. 2 shows a xerographic module, generally designated by the reference numeral 103. Module 103 includes photoconductive member 20, transfer rollers 24 and 26, tensioning roller 28, drive roller 30, corona generating device 34, image back-up roller 29, a bracket 107, a pair of module sideplates 113 and 114, an inboard back-up roller arm 109 and an outboard back-up roller arm 111. Corona generating device 34 is removably mounted on bracket 107 substantially adjacent photoconductive member 20. Back-up roller 29 is attached at its ends to inboard arm 109 and outboard arm 111 respectively. Inboard arm 109 is attached to sideplate 113 by a fastener 123. Inboard arm 109 is also pivotable about fastener 123. Inboard arm 109 includes a beveled portion 133 and further outboard arm 111 includes a beveled portion 135. Outboard arm 111 is attached to sideplate 114 by a fastener 125. The outboard arm is also pivotable about fastener 125. Outboard arm 111 includes a projection 127 which is positionable within a hole 129 defined in sideplate 114 (see also FIG. 5). The extent of pivot of outboard arm 111 is restricted by the positioning of projection 127 within hole 129. Outboard arm 111 is biased toward its upper-most pivot position by a torsion spring 131 as shown in FIG. 5. In addition, inboard arm 109 includes a projection (not shown) which is positionable within a hole (not shown) defined in sideplate 113. Moreover, the extent of pivot of inboard arm 109 is restricted by the positioning of the projection of inboard arm 109 within the hole of sideplate 113 in a manner substantially similar to the restriction of the extent of pivot of outboard arm 111. Inboard arm 109 is biased toward its upper-most pivot position by a torsion spring (not shown).

Figure 3:
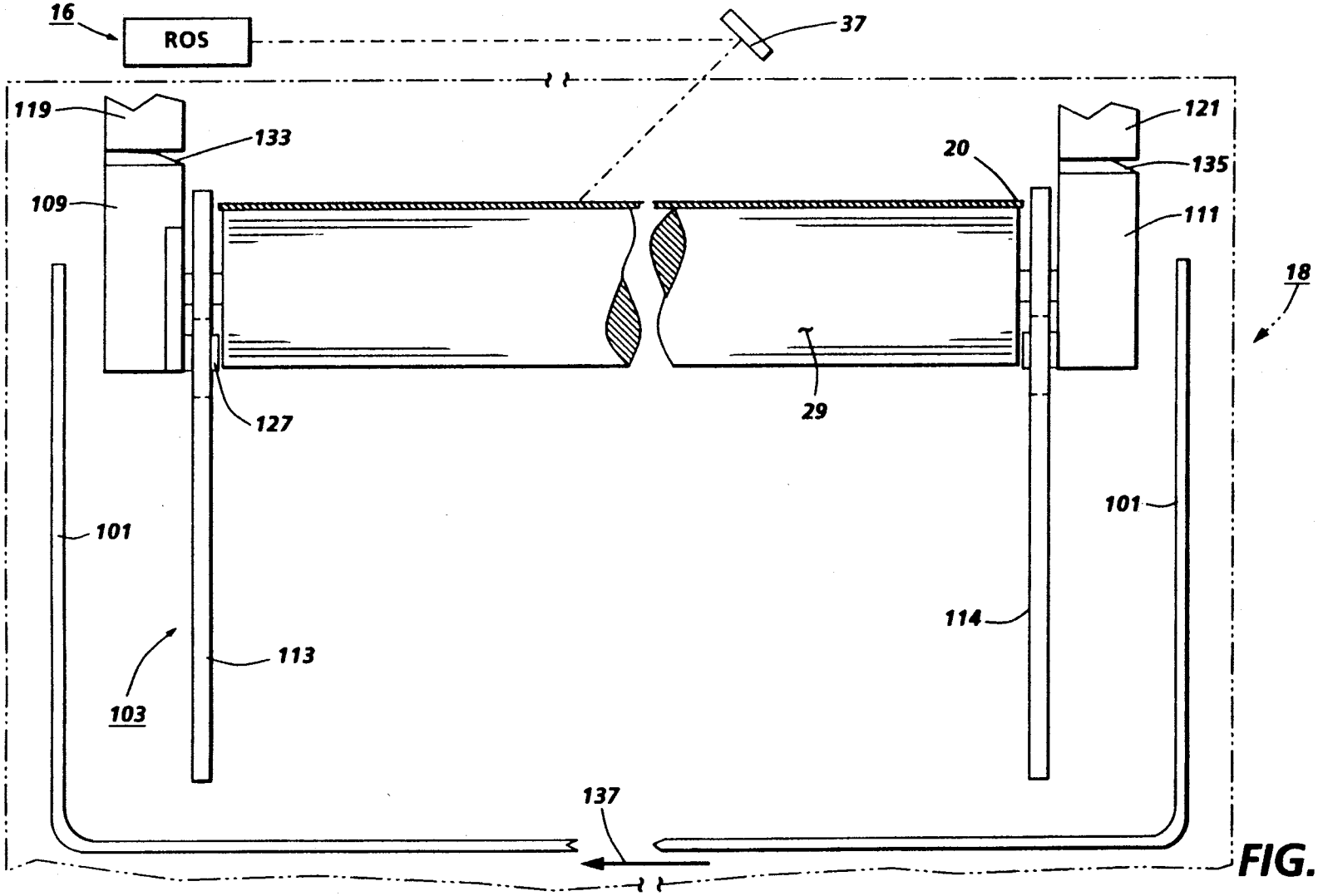
FIG. 3 is a sectional elevational view taken in the direction of arrows 3—3 in FIG. 1 of the module and module drawer used in the electrophotographic printing machine of FIG. 1.

Referring now to FIG. 3, module 103 is positionable in a module drawer 101. Module drawer 101 is insertable within marking engine 18. Marking engine 18 further includes an inboard housing 119 and an outboard housing 121 in which inboard arm 109 and outboard arm 111 are respectively registrable thereagainst. In FIG. 3, module 103 (partially shown) is positioned within module drawer 101 and module drawer 101 is inserted within marking engine 18. When module 103 and module drawer 101 are respectively positioned and inserted as referred to above, photoconductive member 20 of module 103 is registered relative to ROS 16 within marking engine 18. The above is true since inboard arm 109 is spring biased against inboard housing 119 and outboard arm 111 is spring biased against outboard arm 121 so as to position roller 29 and consequently photoconductive member 20 at a predetermined location relative to ROS 16. As shown in FIG. 3, back-up roller 29 is forced against the innerside of photoconductive member 20 so as to the position the photoconductive member at such predetermined location.

Figure 4:
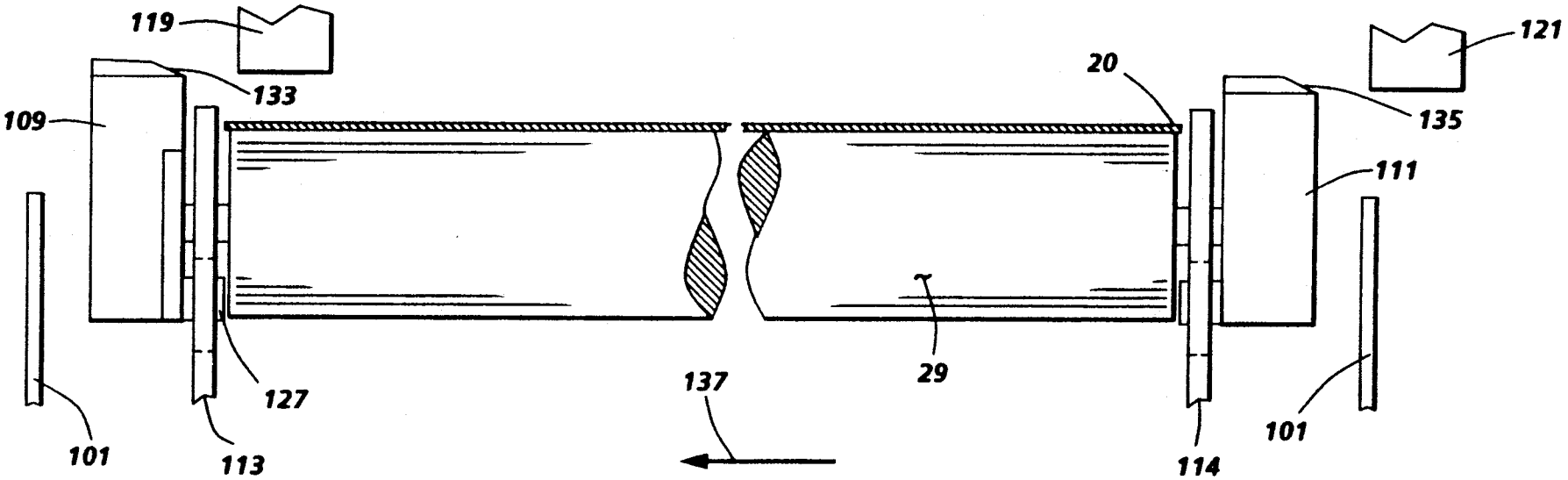
FIG. 4 is a view similar to FIG. 3 but showing the module and module drawer partially displaced for removal of the photoconductive member from the module.

As module drawer 101 is moved in the direction of arrow 137 from its position shown in FIG. 3 to its position shown in FIG. 4, inboard arm 109 and outboard arm 111 respectively move out of contact with the inboard housing and the outboard housing thereby allowing the inboard arm and the outboard arm and consequently back-up roller 29 to pivot to their upper-most pivot position as shown in FIG. 4 (see also FIG. 5). Thus, inboard housing 119 and outboard housing 121 each function as a cam and further inboard arm 109 and outboard arm 111 each function as a cam follower. Moreover, outboard arm 111 is slightly smaller than inboard arm 109 and correspondingly outboard housing 121 is slightly larger than inboard housing 119. The above arrangement allows outboard arm 111 to travel by inboard housing 119 in the direction of arrow 137 without contact during withdrawal of module drawer 101 from marking engine 18 while still allowing outboard arm 111 to be cammed downward due to contact with outboard housing 121 during insertion of module drawer 101 within marking engine 18.

Figure 6:
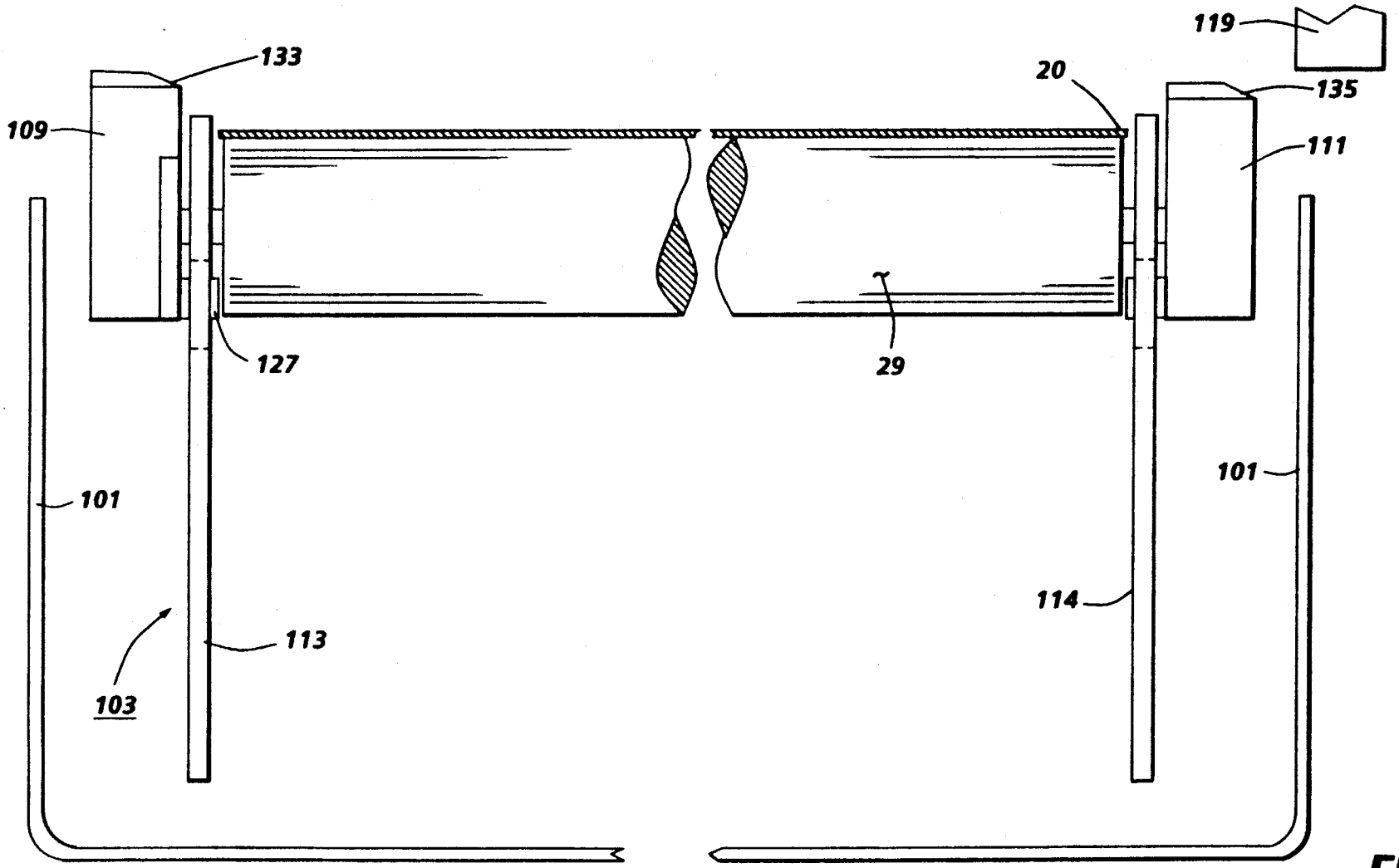
FIG. 6 is a view similar to FIG. 4 but showing the module and and module drawer further displaced for removal of the photoconductive member module.
Figure 8A:
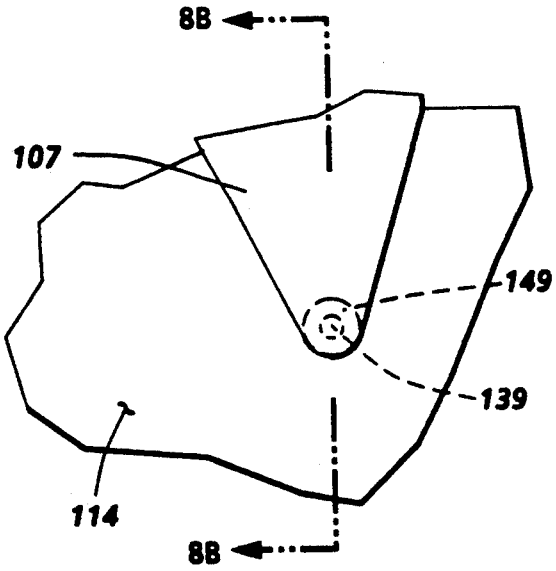
FIG. 8A is a fractional elevational view of the bracket and sideplate of the module of the electrophotographic printing machine of FIG. 1 wherein the bracket is oriented to allow for mounting of the corona generating device thereon.
Figure 8B:
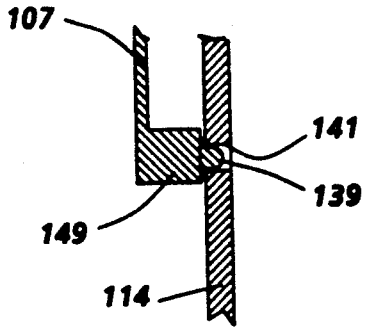
FIG. 8B is a sectional elevational view taken in the direction of arrows 8B—8B of FIG. 8A.
Figure 9B:
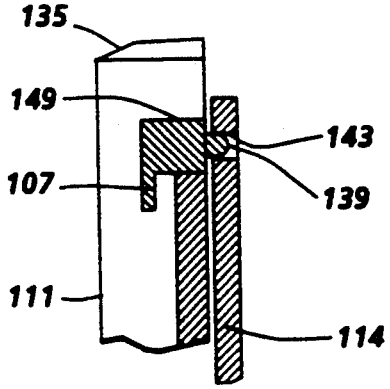
FIG. 9B is a sectional elevational view taken in the direction of the arrows 9B—9B of FIG. 9A.
Figure 9A:
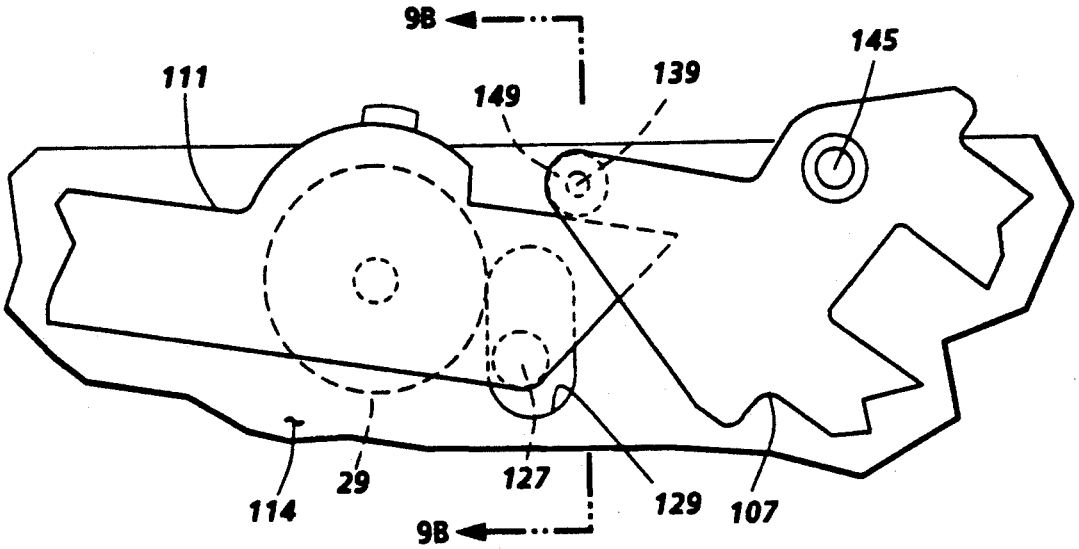
FIG. 9A is a fractional elevational view of the bracket and sideplate of the module of the electrophotographic printing machine of FIG. 1 wherein the bracket is oriented so as to be unable to allow mounting of the corona generating device thereon.

Module 103 is positionable relative to inboard housing 119 and outboard housing 121 such that the module may be removed from module drawer 101. FIG. 6 shows module drawer 101 positioned such that module 103 can be readily removed therefrom. In FIG. 6, inboard arm 109 and outboard arm 111 are positioned in their upper-most pivot position.

Figure 7:
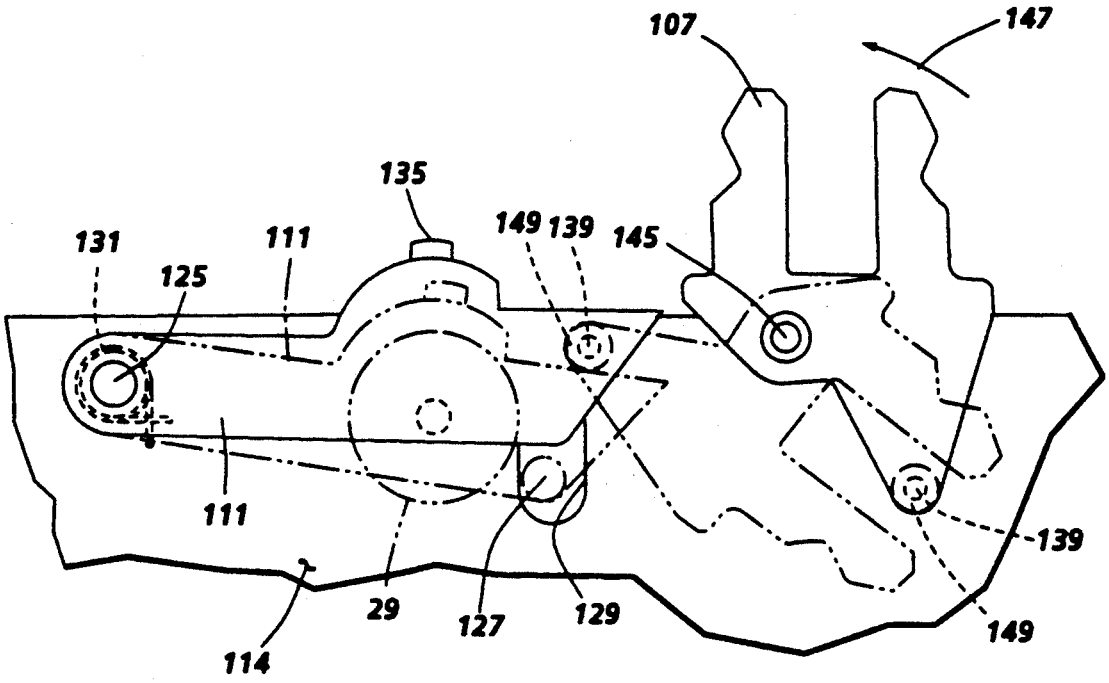
FIG. 7 is a view similar to FIG. 5 but showing the inboard arm held down by the bracket (in phantom) to facilitate removal of the photoconductive member from the module.

Referring now to FIG. 7, bracket 107 is rotatable about a fastener 145. Bracket 107 is biased to a position substantially adjacent sidewall 114 by spring (not shown) mounted on fastener 145. Bracket 107 includes a nodule 149 as shown in FIGS. 7, 8A, 8B, 9A and 9B. Nodule 149 includes a pin 139 which is positionable within a hole 141 defined in sideplate 114 (see FIGS. 7, 8A and 8b). When pin 139 is positioned within hole 141, bracket 107 is oriented so as to be able to mount the corona generating device substantially adjacent photoconductive member 20 as shown in FIG. 7 (see also FIG. 2). Pin 139 is also positionable in another hole 143 defined in sideplate 114 (see FIGS. 7, 9A and 9B). When pin 139 is positioned within hole 143, bracket 107 is oriented so as to be unable to mount the corona generating device substantially adjacent the photoconductive member as shown in phantom in FIG. 7.

Figure 10:
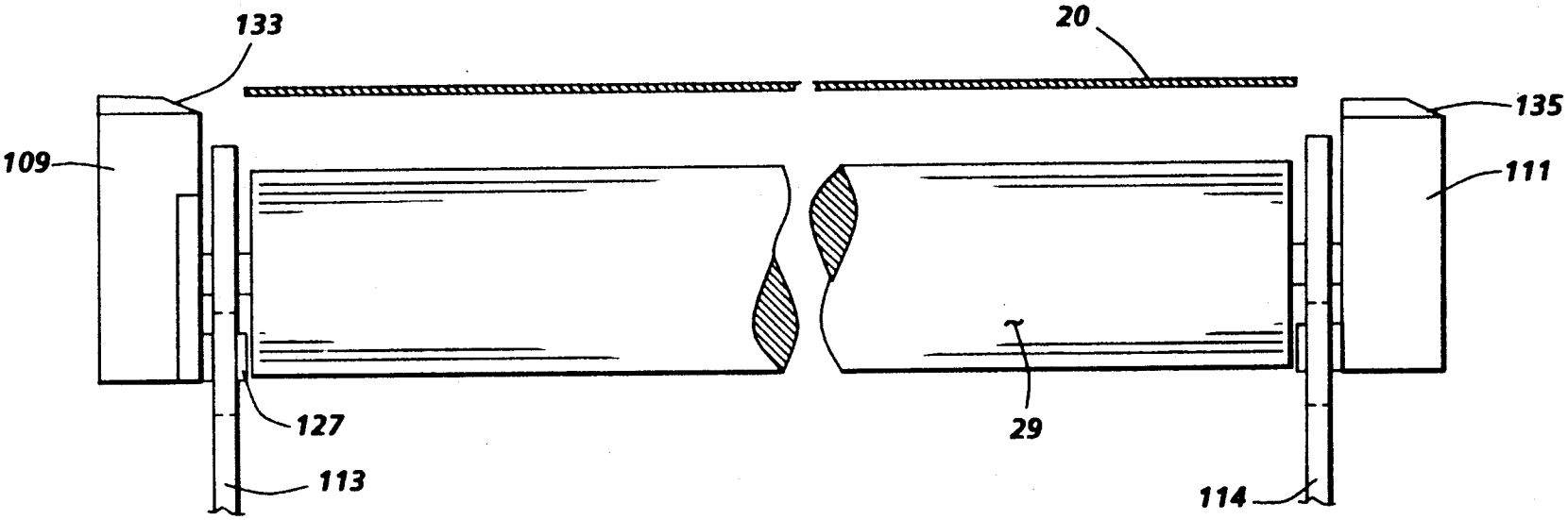
FIG. 10 is a view similar to FIG. 6 but showing the module removed from the module drawer and further showing the inboard arm and the outboard arm positioned for removal of the photoconductive member from the module.

Thus, when it is desired to replace photoconductive member 20 of module 103 of making engine 18 due to damage or wear or the like, module drawer 101 is moved to the position shown in FIG. 6. Module 103 is then removed from module drawer 101 through the opening defined in the top of the module drawer. Thereafter, corona generating device 34 is removed from bracket 107. Bracket 107 is then rotated about fastener 145 in the direction of arrow 147 so as to cause nodule 149 to contact outboard arm 111 thereby forcing the outboard arm to pivot downwardly as shown in FIG. 7. Outboard arm 111 is then held in the lower position against the spring bias of torsion spring 131, as shown in phantom in FIG. 7, by the positioning of pin 139 within hole 143 (see also FIG. 10). When the outboard arm is held at the position described above, including beveled portion 135, is positioned relative to photoconductive member 20 so as to allow the photoconductive member to be easily slide off over the remaining module components including outboard arm 111. Thus, the photoconductive member is slide off over the remaining module components and replaced with a new photoconductive member. After the new photoconductive member has been slide into place over the remaining module components, bracket 107 is then rotated about fastener 145 in the direction opposite to that of arrow 147 until pin 139 is positioned in hole 141 (see e.g. FIG. 5) As a result, outboard arm 111 and consequently back-up roller 29 are urged to their uppermost pivot position. Corona generating device 34 is then remounted on bracket 107. The module is then replaced into module drawer 101 and the module drawer is then reinserted into marking engine 18 thereby causing inboard arm 109 and outboard arm 111 to respectively contact inboard housing 119 and outboard housing 121 so as to register the new photoconductive member relative to ROS 16 within marking engine 18.

It should be noted that if the positioning of the back-up roller 29 were not dependent upon the positioning of bracket 107, it would be possible to remount corona generating device 34 onto bracket 107 without ensuring that the back-up roller was repositioned so as to allow for registration of the photoconductive member relative to ROS 16 within marking engine 18. Therefore, the photoconductive member could be removed from marking engine 18 and replaced with a new photoconductive member while failing to reregister the photoconductive member relative to ROS 16 within marking engine 18. Consequently, in the above condition, the marking engine would produce copies containing image magnification and focus errors. As a result, after discovering the above copying defect, the person replacing the photoconductive member would have to reenter the marking engine and reposition the back-up roller so as to allow for registration of the photoconductive member within the marking engine.

In recapitulation, the apparatus for recording an electrostatic latent image on the photoconductive member of the present invention includes a bracket for mounting the corona generating device thereon. The bracket is also useful for positioning the back-up roller so as to facilitate removal of the photoconductive member from the module. Moreover, the above arrangement reduces the instances in which a person replacing a photoconductive member in a printing machine fails to reposition the back-up roller to a location substantially adjacent the new photoconductive member after the new photoconductive member is installed within the machine.

It is, therefore, apparent that there has been provided in accordance with the present invention, an apparatus for recording an electrostatic latent image on a photoconductive member that fully satisfies the aims and advantages hereinbefore set forth. while this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for recording an electrostatic latent image on a charge receiver, comprising:

means for depositing a substantially uniform electrostatic charge on the charge receiver;

means for selectively dissipating the electrostatic charge on the charge receiver in an imaging zone to record thereon the electrostatic latent image, said dissipating means comprising a support member for supporting at least a portion of the charge receiver in the imaging zone; and means for removably mounting said charge depositing means substantially adjacent the charge receiver, said mounting means being adapted to position said support member at a first position in contact with the charge receiver and at a second position spaced apart from the charge receiver, with the first position allowing for registration of the charge receiver within the apparatus and the second position facilitating removal of the charge receiver from the apparatus.

2. The apparatus of claim 1, wherein said mounting means comprises at least one bracket for removably mounting said charge depositing means thereon.

3. The apparatus of claim 2, wherein said bracket is pivotable between a first bracket position and a second position, with the first bracket position allowing for registration of the charge receiver within the apparatus and the second bracket position facilitating removal of the charge receiver from the apparatus.

4. The apparatus of claim 3, wherein said mounting means further comprises means for releasably securing said bracket at the first bracket position and at the second bracket position.

5. The apparatus of claim 4, wherein said bracket engages said support member when said bracket is secured at the second bracket position.

6. The apparatus of claim 4, wherein said bracket is spaced apart from said support member when said bracket is secured at the first position.

7. The apparatus of claim 1, wherein said dissipating means further comprises means for positioning said support member so as to register the charge receiver within the apparatus.

8. The apparatus of claim 7 wherein said positioning means comprises a cam follower.

9. The apparatus of claim 8, wherein said positioning means further comprises a housing with said cam follower being registrable thereagainst.

10. A printing machine for recording an electrostatic latent image on a charge receiver, comprising:

means for depositing a substantially uniform electrostatic charge on the charge receiver;

means for selectively dissipating the electrostatic charge on the charge receiver in an imaging zone to record thereon an electrostatic latent image, said dissipating means comprising a support member for supporting at least a portion of the charge receiver in the imaging zone; and means for removably mounting said charge depositing means substantially adjacent the charge receiver, said mounting means being adapted to position said support member at a first position in contact with the charge receiver and at a second position spaced apart from the charge receiver, with the first position allowing for registration of the charge receiver within the machine and the second position facilitating removal of the charge receiver from the machine.

11. The printing machine of claim 10, wherein said mounting means comprises at least one bracket for removably mounting said charge depositing means thereon.

12. The printing machine of claim 11, wherein said bracket is pivotable between a first bracket position and a second bracket position, with the first bracket position allowing for registration of the charge receiver within the machine and the second bracket position facilitating removal of the charge receiver from the machine.

13. The printing machine of claim 12, wherein said mounting means further comprises means for releasably securing said bracket at the first bracket position and at the second bracket position.

14. The printing machine of claim 13, wherein said bracket engages said support member when said bracket is secured at the second bracket position.

15. The printing machine of claim 13, wherein said bracket is spaced apart from said support member when said bracket is secured at the first bracket position.

16. The printing machine of claim 10, wherein said dissipating means further comprises means for positioning said support member so as to register the charge receiver within the machine.

17. The printing machine of claim 16, wherein said positioning means comprises a cam follower.

18. The printing machine of claim 17, wherein said positioning means further comprises a housing with said cam follower being registrable thereagainst.

19. The printing machine of claim 10, further comprising:

means for developing the electrostatic latent image recorded on the charge receiver with toner particles;

means for transferring the toner particles to a sheet of support material, in image configuration; and means for substantially permanently fixing the toner particles to the sheet of support material.

20. An apparatus for recording an electrostatic latent image on a charge receiver, comprising:

means for depositing a substantially uniform electrostatic charge on the charge receiver;

means for selectively dissipating the electrostatic charge on the charge receiver in an imaging zone to record thereon the electrostatic latent image, said dissipating means supporting at least a portion of the charge receiver in the imaging zone; and means for removably mounting said charge depositing means substantially adjacent the charge receiver, said mounting means being adapted to position said dissipating means at a first position and at a second position, with the first position allowing for registration of the charge receiver within the apparatus and the second position facilitating removal of the charge receiver from the apparatus, wherein said mounting means comprises at least one bracket for removably mounting said charge depositing means thereon, wherein said bracket is pivotable between a first bracket position and a second bracket position, with the first bracket position allowing for registration of the charge receiver within the apparatus and the second bracket position facilitating removal of the charge receiver from the apparatus, wherein said mounting means further comprises means for releasably securing said bracket at the first bracket position and at the second bracket position, and wherein said bracket engages said dissipating means when said bracket is secured at the second bracket position.

21. The apparatus of claim 20, wherein said bracket is spaced apart from said dissipating means when said bracket is secured at the first bracket position.

22. An apparatus for recording an electrostatic latent image on a charge receiver, comprising:

means for depositing a substantially uniform electrostatic charge on the charge receiver;

means for selectively dissipating the electrostatic charge on the charge receiver in an imaging zone to record thereon the electrostatic latent image, said dissipating means supporting at least a portion of the charge receiver in the imaging zone; and means for removably mounting said charge depositing means substantially adjacent the charge receiver, said mounting means being adapted to position said dissipating means at a first position and at a second position, with the first position allowing for registration of the charge receiver within the apparatus and the second position facilitating removal of the charge receiver from the apparatus, wherein said dissipating means comprises means for registering the charge receiver within the apparatus, and wherein said registering means comprises a cam follower.

23. The apparatus of claim 22, wherein said dissipating means further comprises a housing with said cam follower being registrable thereagainst.

* * * * *